US005784665A

United States Patent [19]

Bae

[11] Patent Number: 5,784,665

[45] Date of Patent: Jul. 21, 1998

[54] APPARATUS AND METHOD FOR DETECTING EXISTENCE OF DEVELOPING UNIT AND RESIDUAL AMOUNT OF TONER IN IMAGE SYSTEM

[75] Inventor: Hee-Man Bae, Yongin, Rep. of Korea

[73] Assignee: SamSung Electronics Co., Ltd., Suwon, Rep. of Korea

[21] Appl. No.: 903,835

[22] Filed: Jul. 31, 1997

[30] Foreign Application Priority Data

Jul. 31, 1996 [KR] Rep. of Korea ..... 1996-32021

[51] Int. Cl.[6] ..... G03G 15/00; G03G 15/08

[52] U.S. Cl. ..... 399/13; 399/27

[58] Field of Search ..... 399/13, 24, 25, 399/27

[56] References Cited

U.S. PATENT DOCUMENTS 4,974,025 11/1990 Kikuchi .
4,998,141 3/1991 Altmann .
5,270,784 12/1993 Nakane et al. .
5,317,369 5/1994 Nakanishi .
5,521,684 5/1996 Takahashi .
5,532,790 7/1996 Akazawa .
5,621,221 4/1997 Shinohara et al. ..... 250/576

FOREIGN PATENT DOCUMENTS 55-143410 11/1980 Japan .
6-67532 3/1994 Japan .
6-161248 6/1994 Japan .

*Primary Examiner*—Joan H. Pendegrass
*Attorney, Agent, or Firm*—Robert E. Bushnell, Esq.

[57] ABSTRACT

An apparatus detects a developing unit and a residual amount of toner. The apparatus includes a magnet mounted under the bottom of a developing unit with a specific distance between them. The apparatus generates a sensing signal upon detecting an up anddown movement of the magnet. Then, in response to the sensing signal, the apparatus generates status messages concerning the existence of the developing unit and a residual amount of the toner. From the status messages, the user may easily check the existence of the developing unit and the residual amount of the toner.

15 Claims, 3 Drawing Sheets

APPARATUS AND METHOD FOR DETECTING EXISTENCE OF DEVELOPING UNIT AND RESIDUAL AMOUNT OF TONER IN IMAGE SYSTEM

CLAIM OF PRIORITY

This application makes reference to, incorporates the same herein, and claims all benefits accruing under 35 U.S.C. §119 from an application entitled Apparatus And Method For Detecting Existence of Developing Unit And Residual Amount of Toner in Image Forming System earlier filed in the Korean Industrial Property Office on 31 Jul. 1996, and there duly assigned Ser. No. 96-3202 by that Office.

BACKGROUND OF THE INVENTION

1. Field of the Invention

The present invention relates to an apparatus and method for detecting a residual amount of toner in an image forming system. More particularly, the present invention relates to an apparatus and method for detecting an existence of a developing unit and a residual amount of toner.

2. Description of the Related Art

Typically, an image forming system such as an electrophotographic printer or a facsimile prints an image onto a printing paper by using toner. The toner must be available in order for printing to occur. Therefore, detection of the existence and availability of the toner in the image forming system is useful. Often, to detect the toner, an agitator is mounted in the developing unit. The agitator refreshes the toner transfers the toner to a supplying roller. In turn, the supplying roller transfers the toner to a magnetic roller. If the residual amount of the toner is not properly detected, the user may be wrong in deciding a proper replacing time of the developing unit. If the developing unit is not replaced with new one at a proper time, the quality of a printed image will be degraded. Of course, this is undesirable. Among the contemporary practice on this matter, Shinohara et al. (U.S. Pat. No. 5,621,221, Toner End Detection Device And Method, Apr. 15, 1997) discusses an apparatus for detecting toner in which an empty condition is detected by emitting light into the toner cartridge. Akazawa (U.S. Pat. No. 5,532,790, Device For Optically Detecting An Amount Of Remaining Developer In An Image Forming Apparatus, Jul. 2, 1996) discusses a device having a light-emitting element for projecting a light for irradiation from the outside to the inside of the vessel and having a light-receiving element. A control device discerns between arrival and no arrival of the residual amount of the developer in the vessel at the prescribed level on the basis of the signal from the light-receiving element. Takahashi (U.S. Pat. No. 5,521,684, Image Forming Apparatus Including Optical Element For Optically Detecting Amount Of Developing Agent In Developer, May 28, 1996) discusses an optical element for optically detecting the amount of the developing agent in the developer. The optical element is arranged at a side opposite to the developer with respect to the convey path of the transfer medium. Nakanishi (U.S. Pat. No. 5,317,369, Apparatus For Detecting Toner In Image Forming Apparatus, May 31, 1994) discusses a sensor for detecting the change of magnetic flux density, the magnetic flux density varying with the amount of toner. Nakane et al. (U.S. Pat. No. 5,270,784, Image Forming Apparatus Having Means For Measuring The Amount Of Developing Agent On the Image Carrier, Dec. 14, 1993) discusses measuring an amount of toner agent deposited on the image carrier. The cover plate is applied with a voltage whose polarity is equal to the polarity of the toner so that an electric field is generated between the image carrier and the cover plate. Altmann (U.S. Pat. No. 4,998,141, *Electret Toner Concentration Monitor*, Mar. 5, 1991) discusses a polarized dielectric member which, when dipped into a development mixture of carrier and toner particles, provides an accurate indication of the toner concentration. Kikuchi (U.S. Pat. No. 4,974,025, Method Of Controlling Toner Concentration In Electrophotographic Developing Apparatus, Nov. 27, 1990) discusses a two-component developer consisting of a carrier and a toner. An approximately periodic waveform component is lapped over the detection signal. From my study of the contemporary art and practice, I find that there is a need for an effective and improved residual toner detection device for an image forming system, especially a device that uses a magnet and motion detection to detect the residual toner.

SUMMARY OF THE INVENTION

Thus, an object of the present invention is to provide an improved apparatus and method for detecting an existence of a developing unit and a residual amount of toner.

Another object of the present invention is to provide an improved apparatus and method for detecting an existence of a developing unit and a residual amount of toner, such that they are capable of preventing degradation of a printed image.

According to an aspect of the present invention, a magnet is mounted under a developing unit containing magnetizable toner. A sensor detects an up and down movement of the magnet that occurs according to a residual amount of the magnetizable toner. This is to detect both an existence of the developing unit and a residual amount of the toner.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT(S)

For the convenience of explanation, the present invention will be described with reference to a laser beam printer which is one of the typical image forming apparatus; as can be seen, the present invention is not necessarily limited to such a laser beam printer.

Figure 1:
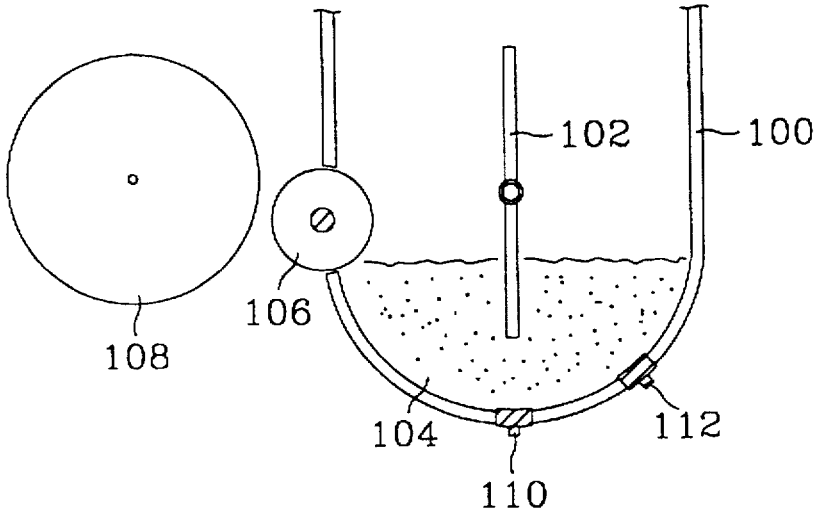
FIG. 1 illustrates a developing unit including sensors for detecting an existence and a residual amount of toner according to a contemporary practice.

FIG. 1 illustrates a contemporary practice. FIG. 1, illustrates a developing unit 100 including sensors 110 and 112 for detecting an existence and a residual amount of toner 104 according to this contemporary practice. As illustrated, an agitator 102 is mounted in the developing unit 100. The agitator 102 is to refresh the toner 104 and to transfer the toner 104 to a supplying roller 106. The supplying roller 106 transfers the toner 104 to a magnetic roller 108. The sensors 110 and 112 for sensing the residual amount of the toner 104 are mounted on the developing unit 100—the sensors 110 and 112 being apart from each other in a specific distance. The sensors 110 and 112 generate a residual amount sensing signal upon detecting the residual amount of the toner 104. Thus, if any one of the sensors 110 and 102 gets out of order or malfunctions for any reason, the residual amount of the toner 104 cannot be properly detected.

If the residual amount of the toner 104 is not properly detected, the user may not decide a proper replacing time of the developing unit 100. Furthermore, if the developing unit 100 is not replaced with new one at a proper time, the quality of a printed image will be degraded—which is undesirable.

Figure 2:
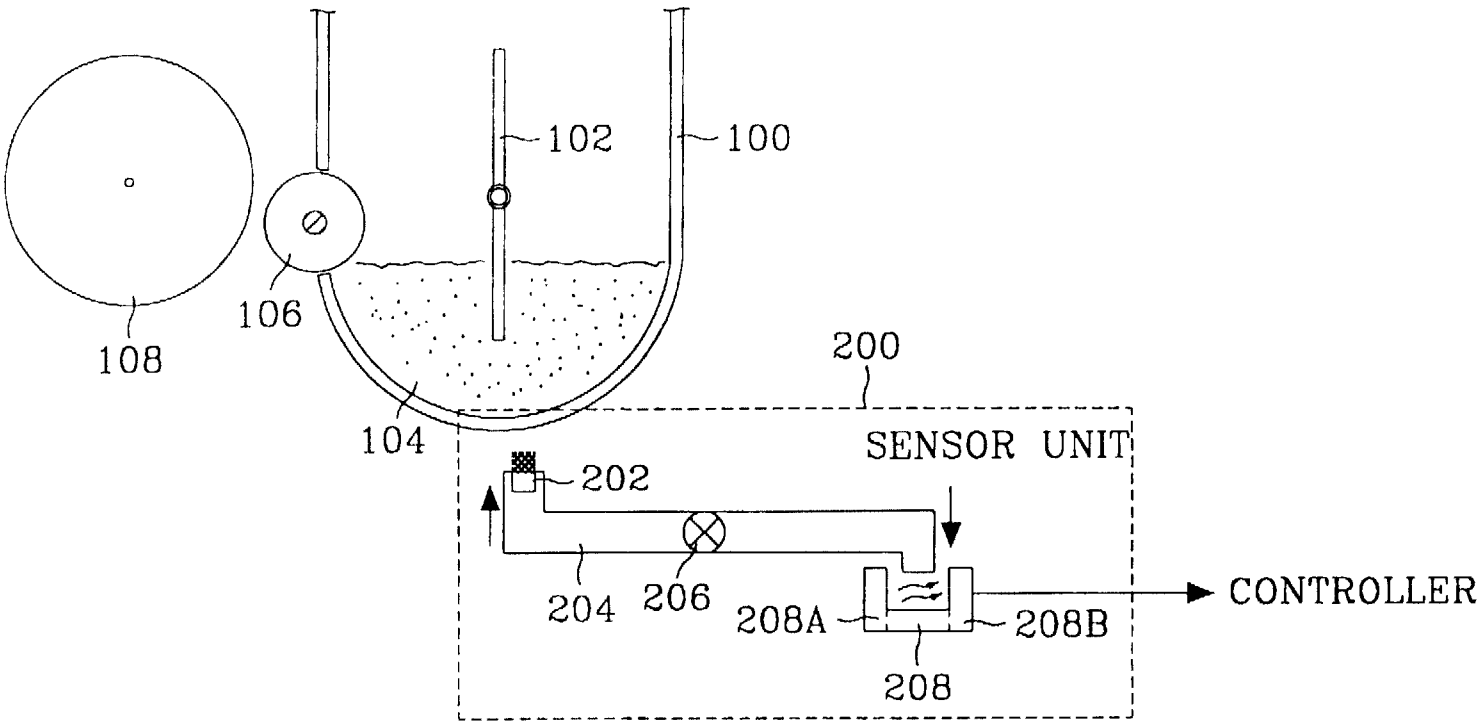
FIG. 2 illustrates a developing unit including a sensor unit for detecting an existence of a developing unit and a residual amount of toner, built in accordance with the principles of an embodiment of the present invention.

There is another way. Referring to FIG. 2, a sensor unit 200 according to an embodiment of the present invention includes a magnet 202 which is movable up and down according to the residual amount of the magnetizable toner 104. A lever 204 is for transferring the up/down movement of the magnet 202 to an optical sensor 208; a central axle 206 for securing a seesaw movement of the lever 204; and the optical sensor 208 is for sensing the up/down movement of the magnet 202 in association with the lever 204 and the central axle 206. This is to generate a sensing signal. Specifically, the lever 204 which undergoes the seesaw movement centered on the central axle 206 includes the magnet 202 mounted on an end thereof. Further, another end of the lever 204 faces closely to the optical sensor 208. The magnet 202 is mounted to be apart at a specific distance from a bottom outer wall of the developing unit 100 containing the magnetizable toner 104.

The distance between the magnet 202 and the bottom of the developing unit 100 is varied according to the residual amount of the magnetizable toner 104 contained in the developing unit 100. For example, in the case where the residual amount of the magnetizable toner 104 contained in the developing unit 100 is relatively large, the magnet 202 moves more closely to the developing unit 100. In contrast, if the residual amount of the magnetizable toner 104 contained in the developing unit 100 is relatively small, the magnet 202 will maintains a constant distance from the developing unit 100. In this way, the magnet 202 moves up and down to the developing unit 100 according to the residual amount of the magnetizable toner 104 contained in the developing unit 100.

The up and down movement of the magnet 202 is transferred to the optical sensor 208 by way of the lever 204 and the central axle 206. The optical sensor 208 includes a light emitting element 208A and a light receiving element 208B. The optical sensor 208 generates the sensing signal when the light receiving element 208B receives a light beam generated from the light emitting element 208A. One end of the lever 204 facing closely to the optical sensor 208 moves up and down between the light emitting element 208A and the light receiving element 208B according to the up/down movement of the magnet 202. The light beam being transferred from the light emitting element 208A toward the light receiving element 208B is blocked and unblocked according to the up/down movement of the lever 204. In this manner, the optical sensor 208 generates the sensing signal according to blocking or unblocking the light beam being transferred from the light emitting element 208A toward the light receiving element 208B, based on the up/down movement of the magnet 202. The sensing signal (generated from the optical sensor 208 according to the residual amount of the toner 104) is transferred to a controller.

Figure 3:
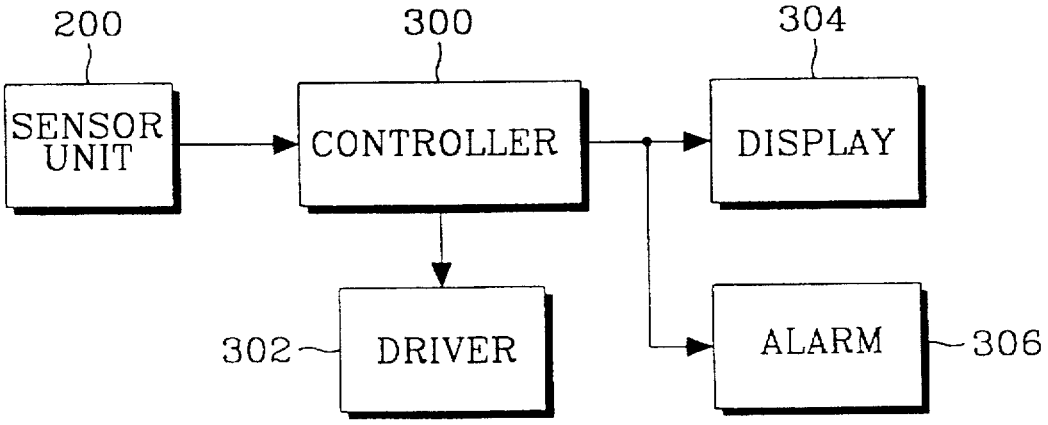
FIG. 3 shows a block diagram of an apparatus for detecting an existence of a developing unit and a residual amount of toner in accordance with the principles of an embodiment of the present invention.

FIG. 3 gives a block diagram of the apparatus for detecting an existence of the developing unit 100 and a residual amount of the toner 104 according to the present invention. As illustrated in FIG. 3, the invention apparatus includes the sensor unit 200 (also shown in FIG. 2) for sensing the residual amount of the toner 104 to generate the sensing signal. A controller 300 is for controlling an overall operation of the invention apparatus according to the sensing signal; a driver 302 is for driving various mechanisms according to the control of the controller 300; a display is for displaying a display message; and an alarm 306 is for generating an alarm sound.

Figure 4:
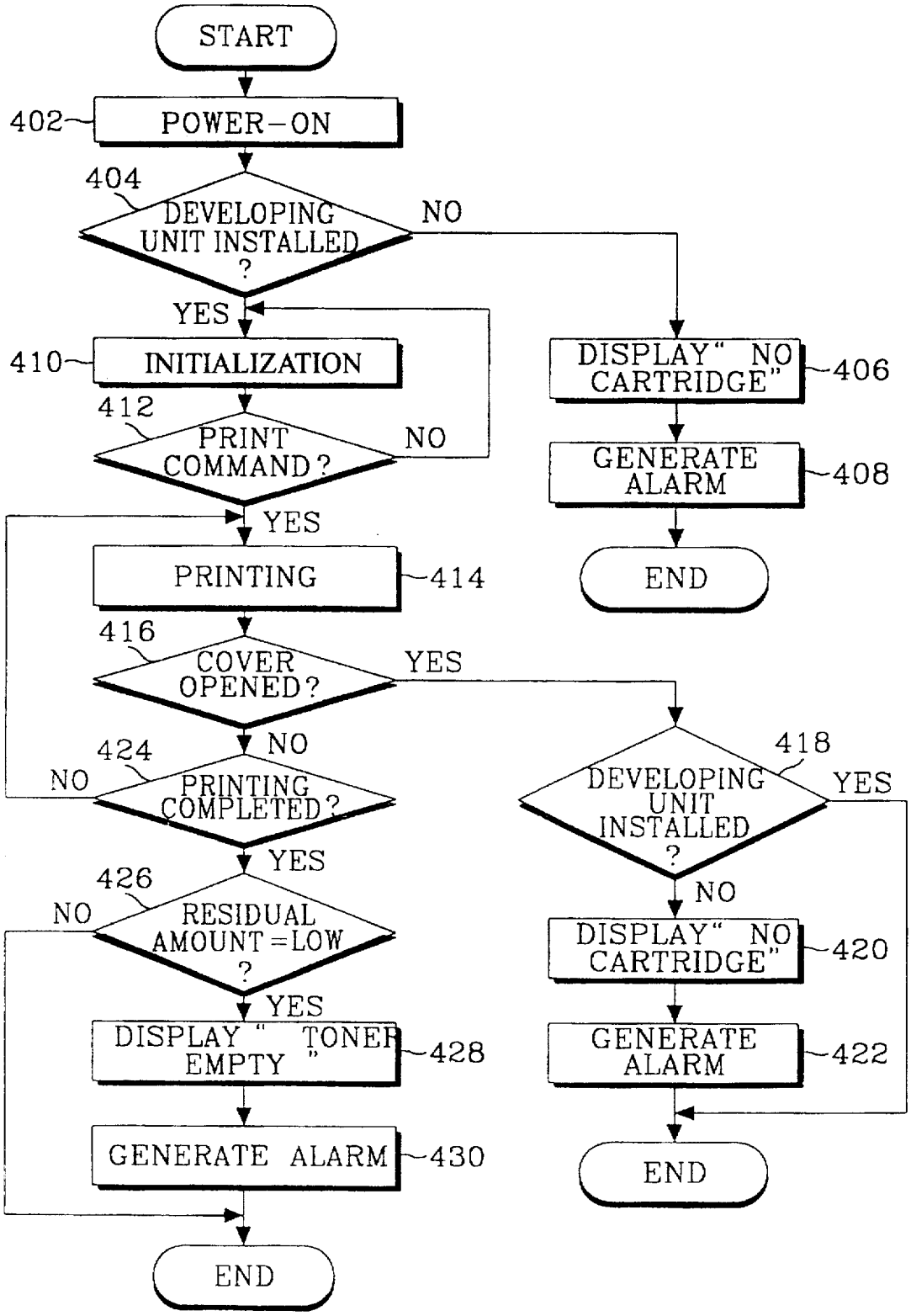
FIG. 4 illustrates a process flow of the apparatus for detecting an existence of a developing unit and a residual amount of toner in accordance with the principles of an embodiment of the present invention.

FIG. 4 shows a process flow of the apparatus for detecting an existence of the developing unit 100 and a residual amount of the toner 104 according the present invention. The description that follows refer to FIGS. 2 through 4, with respect to an operation of the apparatus for detecting an existence of the developing unit 100 and a residual amount of the toner 104 according the present invention. At a step 402, the image forming system is powered on to provide each part of the system such as the controller 300 and the driver 302 with a supply voltage. Then, depending on the sensing signal generated from the sensor unit 200, the controller 300 checks whether or not the developing unit 100 is currently being installed, at a step 404.

If the developing unit 100 is not currently being installed, then the controller 300 controls the display 304 to generate a corresponding display message, for example, "NO CARTRIDGE", at a step 406. Then, the controller 300 controls the alarm 306 so as to generate an alarm sound.

In contrast, if the developing unit 100 is currently being installed, then the controller 300 initializes the image forming system at a step 410. Then, the controller 300 checks, at a step 412, whether or not a printing command signal is received. If the printing command signal is not received, the controller 300 returns to the step 410 to maintain the image forming system at an initial driving status. Meanwhile, if the printing command signal is received, the controller 300 controls the driver 302 to perform a printing operation, at a step 414. The controller 300 checks, at a step 416, whether or not a cover of the image forming system is opened during the printing operation.

If the cover is discovered to be opened during the printing operation (at step 416), then developing unit may need to be checked. For example, if the cover is opened by the user because of a paper jam during the printing operation, the controller 300 checks, at a step 418, whether or not the developing unit 100 is currently being installed, depending upon the sensing signal generated from the sensor unit 200. If the developing unit 100 is currently being installed, the process flow is ended immediately. However, if the developing unit 100 is not currently being installed, the controller 300 controls the display 304 to display the corresponding display message, for example, "NO CARTRIDGE", at a step 420. Furthermore, the controller 300 controls the alarm 306 to generate the alarm sound, at a step 422.

In contrast, if the cover is not opened at the step 416, the controller 300 checks whether or not the printing operation has been completed, at a step 424. If the printing operation is not completed, the controller 300 executes the step 414 and the succeeding steps. Meanwhile, if the printing operation is completed, the controller 300 checks, at a step 426, whether or not the residual amount of the toner 104 is smaller (or lower) than a predetermined amount, based upon the sensing signal generated from the sensor unit 200. If the residual amount of the toner 104 is not smaller than the predetermined amount, the controller 300 completes the process flow immediately. However, if the residual amount of the toner 104 is smaller than the predetermined amount, the controller 300 controls the display 304 to display a corresponding status message, for example, "TONER EMPTY", at a step 428. Then, the controller 300 controls the alarm 306 to generate the alarm sound, at a step 430.

As described in the foregoing, an apparatus according to the present invention includes a magnet mounted under the bottom outer wall of a developing unit with a specific distance therebetween. This is so as to generate a sensing signal by detecting an up/down movement of the magnet. Then, the apparatus generates status messages concerning an existence of the developing unit and a residual amount of the toner, in response to the sensing signal. From the status messages, the user may easily check the existence of the developing unit and the residual amount of the toner.

Although a preferred embodiment of the present invention has been described in detail hereinabove, it should be clearly understood that many variations and/or modifications of the basic inventive concepts herein taught which may appear to those skilled in the art will still fall within the spirit and scope of the present invention as defined in the appended claims.

What is claimed is:

1. An apparatus for detecting an existence of a developing unit and for detecting an existence of a toner in an image forming system, comprising:

a magnet mounted under a bottom outer wall of the developing unit containing the toner, the toner being magnetizable;

a sensor for generating a sensing signal upon detecting an up and down movement of said magnet, the up and down movement of said magnet occurring in accordance with a residual amount of the toner in the developing unit, the residual amount of the toner being magnetizable, the detecting occurring in accordance with the residual amount of the toner contained in the developing unit; and a controller for performing a control operation in accordance with the sensing signal by checking the existence of the developing unit and the existence of the residual amount of the toner.

2. The apparatus of claim 1, wherein said sensor comprises:

a lever having a first end mounting said magnet and a second end facing said sensor, said lever turning in dependence upon the up and down movement of said magnet, said lever transferring a turning movement to said sensor during said lever turning.

3. The apparatus of claim 2, wherein said sensor further comprises:

a light emitting element for generating an optical signal; and a light receiving element for receiving said optical signal generated from said light emitting element; and said lever being mounted between said light emitting element and said light receiving element, said sensor generating the sensing signal in accordance with blocking and unblocking the optical signal being sent from said light emitting element toward said light receiving element, said sensor generating the sensing signal in dependence upon the turning movement of the lever.

4. The apparatus of claim 3, wherein said controller generates a display message and an alarm message in accordance with the sensing signal, the display message containing information to be shown to a user, the alarm message for alarming the user.

5. The apparatus of claim 4, further comprising a display for displaying the display message.

6. The apparatus of claim 4, further comprising an alarm for generating an alarm sound based on the alarm message.

7. The apparatus of claim 2, wherein said lever rotates around a central axle.

8. An apparatus for detecting an existence of a developing unit and an existence of a residual amount of magnetizable toner in an image forming system having a magnet mounted under the developing unit containing the toner, the image forming system having a sensor for generating a sensing signal in accordance with the residual amount of the toner, comprising the steps of:

means for detecting an up and down movement of said magnet in accordance with the residual amount of the magnetizable toner, said magnet moving up and down in accordance with the residual amount of the toner;

means for generating the sensing signal in accordance with the residual amount of the toner;

means for checking the existence of the developing unit and the existence of the residual amount of the toner, in dependence upon the sensing signal; and means for generating a display message in accordance with results of said means for checking the existence of the developing unit and the existence of the residual amount of the toner, the display message containing information to be shown to a user.

9. The apparatus of claim 8, wherein a first status message corresponding to the existence of the developing unit is generated during an initial power on time period and a second status message corresponding to the residual amount of the toner is generated after completion of a printing operation, the image forming system initializing and powering during the initial power on time period, and the printing operation forming an image onto a print medium.

10. The apparatus of claim 8, further comprising means for generating an alarm sound in accordance with the sensing signal.

11. The apparatus of claim 8, further comprising means for checking whether a cover of the image forming system is open.

12. A method for detecting an existence of a developing unit and an existence of a residual amount of magnetizable toner in an image forming system having a magnet mounted under the developing unit containing the toner, the image forming system having a sensor for generating a sensing signal in accordance with the residual amount of the toner, comprising the steps of:

detecting an up and down movement of said magnet in accordance with the residual amount of the magnetizable toner, said magnet moving up and down in accordance with the residual amount of the toner;

after said step of detecting the up and down movement of said magnet, generating the sensing signal in accordance with the residual amount of the toner;

checking the existence of the developing unit and the existence of the residual amount of the toner, in dependence upon the sensing signal; and generating a display message in accordance with results of the step of checking the existence of the developing unit and the existence of the residual amount of the toner, the display message containing information to be shown to a user.

13. The method of claim 12, wherein a first status message corresponding to the existence of the developing unit is generated during an initial power on time period and a second status message corresponding to the residual amount of the toner is generated after completion of a printing operation, the image forming system initializing and powering during the initial power on time period, and the printing operation forming an image onto a print medium.

14. The method of claim 12, further comprising the step of generating an alarm sound in accordance with the sensing signal.

15. The method of claim 12, further comprising the step of checking whether a cover of the image forming system is open.

* * * * *